US011136713B2

(12) United States Patent
Pelto-Huikko

(10) Patent No.: US 11,136,713 B2
(45) Date of Patent: *Oct. 5, 2021

(54) STEEL WIRE ROPE, ELEVATOR PROVIDED WITH STEEL WIRE ROPE, LUBRICANT FOR STEEL WIRE ROPE, AND USE OF LUBRICANT FOR LUBRICATING THE STEEL WIRE ROPE

(71) Applicant: Kone Corporation, Helsinki (FI)

(72) Inventor: Raimo Pelto-Huikko, Helsinki (FI)

(73) Assignee: Krone Corporation, Helsinki (FI)

( * ) Notice: Subject to any disclaimer, the term of this patent is extended or adjusted under 35 U.S.C. 154(b) by 453 days.

This patent is subject to a terminal disclaimer.

(21) Appl. No.: 16/176,604

(22) Filed: Oct. 31, 2018

(65) Prior Publication Data

US 2019/0062993 A1 Feb. 28, 2019

Related U.S. Application Data

(63) Continuation of application No. PCT/FI2016/050437, filed on Jun. 16, 2016.

(51) Int. Cl.
*D07B 1/14* (2006.01)
*B66B 7/12* (2006.01)
(Continued)

(52) U.S. Cl.
CPC ..... *D07B 1/144* (2013.01); *B66B 7/06* (2013.01); *B66B 7/1261* (2013.01); *B66B 9/00* (2013.01);
(Continued)

(58) Field of Classification Search
CPC ..... D07B 1/144; D07B 1/0673; D07B 2501/2007; D07B 2201/2009;
(Continued)

(56) References Cited

U.S. PATENT DOCUMENTS

2003/0008961 A1 1/2003 Uematsu
2011/0136708 A1* 6/2011 Mabuchi ..... C10M 141/12 508/122
(Continued)

FOREIGN PATENT DOCUMENTS

CN 102459545 A 5/2012
EP 1688384 A2 8/2006
(Continued)

OTHER PUBLICATIONS

Japanese Office Action dated Dec. 12, 2019 issued in corresponding Japanese Application No. 2018-561248.
(Continued)

*Primary Examiner* — Vishal V Vasisth
(74) *Attorney, Agent, or Firm* — Harness, Dickey & Pierce, P.L.C.

(57) ABSTRACT

A wire rope is disclosed that comprises metal wires, preferably steel wires, as a load-bearing material, which rope comprises at least one or more strands laid from said metal wires and which rope is lubricated with a lubricant. Another object is the use of the aforementioned lubricant for lubricating a steel rope. The lubricant comprises at least oil and powder substance, which powder substance comprises at least particles whose hardness is greater than 4 on the Mohs scale.

Figure 1:
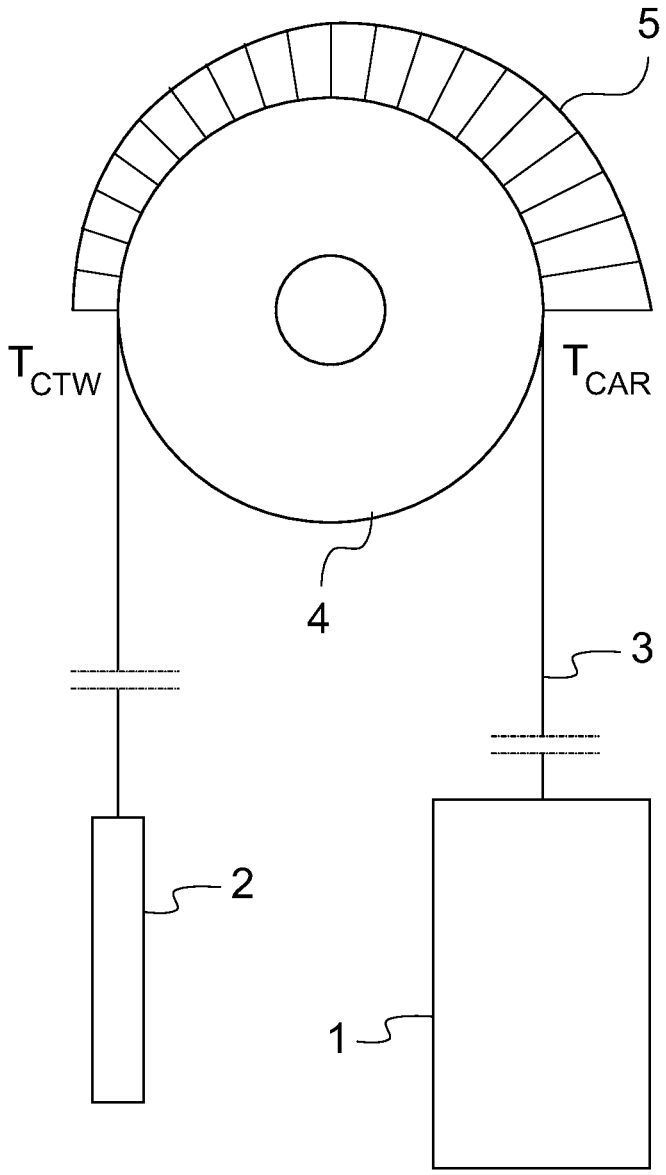

A traction sheave elevator comprising such a wire rope as a suspension rope is disclosed, too.

24 Claims, 3 Drawing Sheets

(51) Int. Cl.

| | |
|---|---|
| ***C10M 169/02*** | (2006.01) |
| ***C10M 113/08*** | (2006.01) |
| ***C10M 171/06*** | (2006.01) |
| ***C10M 125/10*** | (2006.01) |
| ***B66B 7/06*** | (2006.01) |
| ***B66B 9/00*** | (2006.01) |
| *C10N 10/14* | (2006.01) |
| *C10N 20/06* | (2006.01) |
| *C10N 40/32* | (2006.01) |
| *C10N 50/10* | (2006.01) |
| *D07B 1/06* | (2006.01) |

(52) U.S. Cl.

CPC ..... *C10M 113/08* (2013.01); *C10M 125/10* (2013.01); *C10M 169/02* (2013.01); *C10M 171/06* (2013.01); *C10M 2201/05* (2013.01); *C10M 2201/0626* (2013.01); *C10M 2203/003* (2013.01); *C10N 2010/14* (2013.01); *C10N 2020/06* (2013.01); *C10N 2040/32* (2013.01); *C10N 2050/10* (2013.01); *D07B 1/0673* (2013.01); *D07B 2201/102* (2013.01); *D07B 2201/2009* (2013.01); *D07B 2205/502* (2013.01); *D07B 2205/507* (2013.01); *D07B 2401/2065* (2013.01); *D07B 2501/2007* (2013.01)

(58) Field of Classification Search

CPC ..... D07B 2201/102; D07B 2205/502; D07B 2205/507; D07B 2401/2065; C10M 169/02; C10M 113/08; C10M 2203/003; C10M 2201/0626; B66B 7/1261; B66B 7/06; B66B 9/00

See application file for complete search history.

(56) References Cited

U.S. PATENT DOCUMENTS

| | | | | |
|---|---|---|---|---|
| 2012/0061188 | A1 | 3/2012 | Aulanko et al. | |
| 2012/0312637 | A1* | 12/2012 | Aulanko | D07B 1/144 187/254 |
| 2013/0190441 | A1* | 7/2013 | Vucak | C09C 1/021 524/425 |

FOREIGN PATENT DOCUMENTS

| | | | |
|---|---|---|---|
| EP | 2316912 | A1 | 5/2011 |
| EP | 2409952 | A1 | 1/2012 |
| GB | 2353537 | A | 2/2001 |
| JP | 2002338981 | A | 11/2002 |
| JP | 2007-211070 | A | 8/2007 |
| JP | 2009-292918 | A | 12/2009 |
| WO | WO-2010133769 | A1 | 11/2010 |
| WO | WO-2011144816 | A1 | 11/2011 |

OTHER PUBLICATIONS

Office Action dated Dec. 2, 2020 in Chinese Application No. 2017800350312.

International Search Report for PCT/FI2017/050451 dated Sep. 12, 2017.

Written Opinion for PCT/FI2017/050451 dated Sep. 12, 2017.

International Search Report PCT/ISA/210 for International Application No. PCT/FI2016/050437 dated Mar. 20, 2017.

Written Opinion of the International Searching Authority PCT/ISA/237 for International Application No. PCT/FI2016/050437 dated Mar. 20, 2017.

* cited by examiner

STEEL WIRE ROPE, ELEVATOR PROVIDED WITH STEEL WIRE ROPE, LUBRICANT FOR STEEL WIRE ROPE, AND USE OF LUBRICANT FOR LUBRICATING THE STEEL WIRE ROPE

This application is a continuation of PCT International Application No. PCT/FI2016/050437 which has an International filing date of Jun. 16, 2016, the entire contents of which are incorporated herein by reference.

The object of the invention is a steel wire rope as defined in the preamble of claim 1, an elevator provided with a steel wire rope as defined in the preamble of claim 10, a lubricant as defined in the preamble of claim 15, and the use of a lubricant for lubricating a steel wire rope as defined in the preamble of claim 20.

Ropes laid from metal wires, more particularly the hoisting ropes, i.e. suspension ropes, of elevators or other hoisting apparatuses are generally lubricated with some suitable lubricant. Lubrication improves the operation of ropes and reduces the wearing of the ropes, in which case the service life of the ropes lengthens. Lubrication also prevents the rusting of ropes. Ropes are usually lubricated in connection with the manufacture of the ropes, e.g. such that a lubricant is spread into the rope structure to be manufactured. Usually elevator ropes are steel wire ropes. A steel wire rope or one or more of the strands of a steel wire rope may comprise a core of a softer material, such as plastic or hemp.

Conventionally the lubricant used in steel elevator ropes is paraffin-based. A problem when using paraffin is, however, when the ropes get hot the structure of the oil thins, in which case the oil bound by the paraffin can easily detach from the rope. Another problem with paraffin-based lubricant is that the traction sheave-rope contact becomes more slippery at a higher temperature, due to which it can be difficult to get the friction factor between the traction sheave and the rope to meet the values required by elevator regulations. If the friction factor is too small, the ropes can slip on the traction sheave, which causes problems and can also be a safety risk. Other relatively thin lubricants have the same type of problems as oil mixed with paraffin.

The solution of the same applicant presented in the international patent publication No. WO2011144816 A1 shows a steel rope with a lubricant that comprises oil and relative high proportion of thickener, which thickener comprises one or more solid additives of a softer material than the steel wires of the rope. The present invention is an advantageous improvement to the solution of the WO publication.

Normally it is desired to make elevators and elevator structures as light as possible, in which case the elevator would be cheaper to manufacture and install. As the elevator car and the counterweight become lighter, however, the friction between the elevator ropes and the traction sheave decreases at the same time. The reduction in friction thus limits the making of lighter elevators; a general aim is to achieve high friction but, however, such that the ropes do not wear too quickly.

The idea of this invention is to equip an elevator with the type of elevator ropes in which lubricant that contains solid additives that are about equal hard as the steel wires in the steel rope or even harder, is used as a lubricant instead of oil, paraffin or oil mixed with paraffin. The hard additives make it possible to achieve friction between the elevator ropes and the traction sheave which is greater than with elevator ropes that are lubricated according to prior art.

The aim of this invention is to eliminate the aforementioned drawbacks and to achieve a steel wire rope, e.g. a suspension rope of a traction sheave elevator, that is lubricated with a lubricating grease type of lubricant, the friction factor between which suspension rope and traction sheave is greater than in existing solutions. In addition, one aim is to achieve a suspension rope of a traction sheave elevator, the service life of which suspension rope is longer than before. Yet another aim is to achieve a suspension rope of a traction sheave elevator in which the lubricant stays on the rope well during the operation of the rope. The aim of the invention is also to achieve a traction sheave elevator, in which the suspension ropes are lubricated with a lubricating grease type of lubricant. Additionally the aim of the invention is to achieve the use of a lubricating grease type of lubricant for lubricating a steel wire rope, such as the suspension rope of an elevator. And a particular aim of the invention is to improve the solution presented in the international patent publication No. WO2011144816 A1.

The steel wire rope according to the invention is characterized by what is disclosed in the characterization part of claim 1 and the elevator provided with the steel wire rope according to the invention is characterized by what is disclosed in the characterization part of claim 9. Correspondingly, the lubricant according to the invention is characterized by what is disclosed in the characterization part of claim 13, and the use of the lubricant for lubricating the steel wire rope according to the invention is characterized by what is disclosed in the characterization part of claim 17. Other embodiments of the invention are characterized by what is disclosed in the other claims.

An aspect of the invention relates to a way to lubricate a steel wire rope using a paste type lubricant, which comprises oil and hard powder substance. The essential or main part of the particles of the powder substance are of hardness about equal or greater than that of the steel wires of the rope. In all lubricants according to the invention the hardness of main part of the particles of the powder substance is at least 4 on the Mohs scale.

Suitable powder materials are for example $Mn_3O_4$ and $MnO_2$, but other powder materials having about similar characteristics are suitable, too.

Preferably the powder material does not bind water in or on its particles. Advantageous powder materials are rather hydrophobic ones than hydrophilic ones.

Preferably the particles comprised in the lubricant are spheres or chunks or ovals. Advantageously the ratio of the longest dimension to the shortest dimension of a particle, i.e. the internal aspect ratio of the particle, is at most about 5. Preferably the internal aspect ratio is less than 2, more preferably less than 1.5, even more preferably at most about 1.2, most preferably as close to one as possible. In an ideal powder substance all or almost all particles are spheres or nearly spheres, thus resulting the average aspect ratio at most about 1.2.

An advantageous way to practice the invention is to apply the invention in connection with elevator ropes or their lubrication. A clear advantage is improved traction between the iron or steel traction sheave and steel wire ropes used as hoisting ropes. An advantage is also the extended life time of such hoisting ropes. The same advantages are reached also in connection of using rubber, polyurethane or corresponding material coated traction sheaves to drive the hoisting ropes. The traction sheave coating type could be for example like coatings disclosed in the embodiments of EP 1688384 A2.

Today a major part of the ropes used in elevators are in range of tensile strength between 1370 $N/m^2$ and 1960 $N/m^2$. Ropes made of steel wires of higher tensile strength are also used in elevators, particularly in case of elevators applying hoisting ropes thinner than 8 mm.

Preferably the lubricant comprises at least oil and more than 50% of the weight of the lubricant solid powder substance that acts as thickener. The thickener comprises one or more solid additives in small particles that are about as hard as the metal wires of the rope or harder, and preferably the thickener is non-organic.

Advantageously in the lubricant of the invention a thickener comprising one or more solid additives is mixed to the oil a large enough proportion, so that the mixture of the oil and thickener forms a paste.

The powder substance should be rather fine. Advantageously the particle size is below 75 μm. Preferable at least 50% of mass of the powder substance belongs to the particle size range from 1 to 10 μm.

Advantageously the lubricant also contains a small amount of binder agents, for example about 0 to 10% of the weight of the lubricant. Other additives may also be used, for example such ones improving storage properties.

An aspect of the invention is to lubricate metal ropes, in practice steel wire ropes, which possibly contain non-metal parts.

Another aspect of the invention is a traction sheave elevator, comprising at least an elevator car, possibly a counterweight and a plurality of suspension ropes, comprising one or more strands composed of steel wires, which ropes are led to pass over a traction sheave provided with a hoisting machine and which suspension ropes are lubricated with a lubricant that comprises at least oil. The lubricant of the suspension ropes of the traction sheave elevator according to the invention is in a form of paste and the powder substance in the lubricant comprises particles whose hardness is greater than 4 on the Mohs scale.

In addition, the powder substance comprises particles whose hardness is about equal to the hardness of the steel of the wires of the strands of suspension ropes, or greater than the hardness of the steel of the wires of the strands of suspension ropes.

Still another aspect of the invention is a rope lubricant for a steel wire rope, which rope comprises one or more strands composed of steel wires. The rope lubricant comprises oil and powder substance, which powder substance in the lubricant comprises particles whose hardness is greater than 4 on the Mohs scale.

Yet another aspect of the invention is a use of the aforementioned lubricant for lubricating a rope, e.g. a steel rope, that contains metal as a load-bearing material.

One advantage, among others, of the solution according to the invention is that the friction between the elevator ropes and the rope grooves of the traction sheave is greater than with conventional oil- or grease-lubricated elevator ropes. Another advantage is that, as a result of the better friction on the traction sheave, the slip control of the elevator ropes on the traction sheave also improves. From the advantages presented above follows the advantage that the torque of the motor can be utilized more efficiently, as the ratio of the rope forces on different sides of the traction sheave can be made greater, which enables an improvement of the ratio of the net useful load and the deadweight of the car. A further advantage is that the greater friction allows a smaller diameter of the traction sheave, or correspondingly a smaller contact angle of the elevator ropes and the traction sheave. One advantage is also that, owing to the better friction, smaller and lighter structures can be used in the elevator, which also results in a reduction of costs. An additional advantage is that the elevator ropes do not rust or wear easily, so consequently the lifetime of the rope is much longer compared e.g. to a rope lubricated with paraffin. Another advantage is that the lubricant penetrates inside the rope very well and stays attached to the rope well, and does not detach from it easily or splash into other parts of the elevator.

A further advantage is that with the invention the service life of the rope is longer than with ropes lubricated with conventional methods. One important aspect of the invention is that the friction factor between the traction sheave and the rope is sufficiently large owing to the amount of lubrication being correct and the lubricant having a friction factor higher than that of paraffin. Thus the rope does not slip on the traction sheave in the operating conditions of the elevator. A further advantage is that the lubricant stays tightly on the rope and does not detach from it easily, e.g. from the effect of centrifugal force, even if the rope becomes very warm. In this case higher speeds can be used safely. A further advantage is that the arrangement is simple and inexpensive to implement. Still a further advantage is that hard particles in the lubricant are not crushed, and a substantially round shape of the particles makes the particles act as a ball bearing. The hard, round shaped particles in the lubricant also prevent the opposing surfaces to touch each other.

Ropes, more particularly steel ropes that are lubricated with a lubricant comprising solid substances, such as grease, a grease compound or paste or corresponding, are also within the scope of the inventive concept. The lubricating is performed preferably onto a wire or strand of the rope before closing the lay structure of the rope.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment of the invention can also be applied in other embodiments. In addition it can be stated that at least some of the subordinate claims can at least in suitable situations be deemed to be inventive in their own right.

Figure 2:
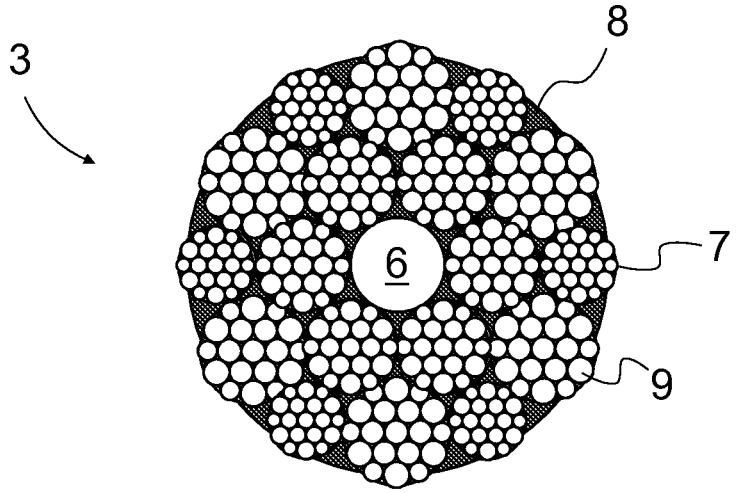
Figure 3:
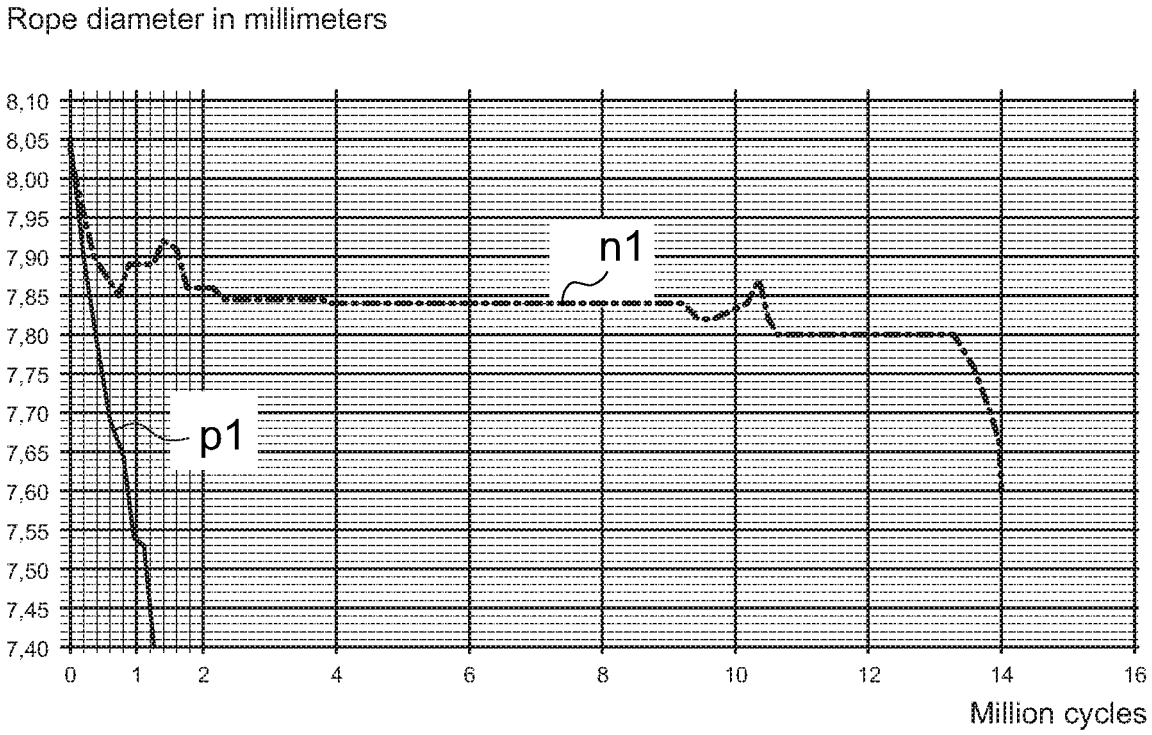
Figure 4:
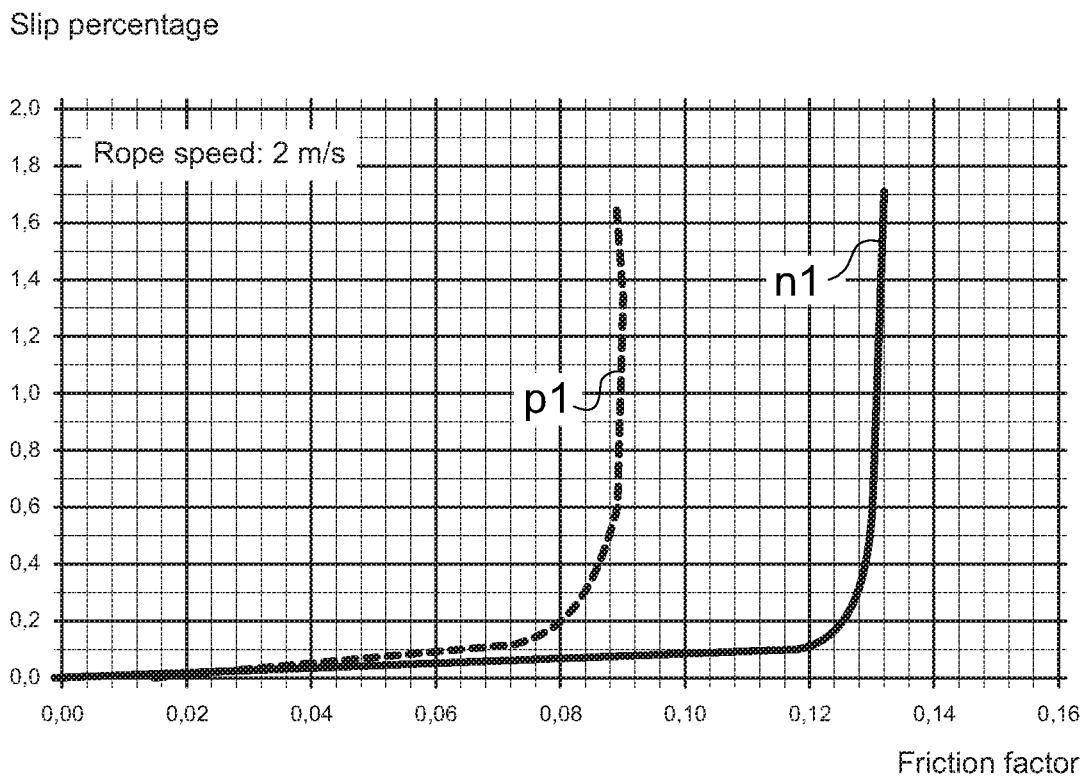
Figure 5:
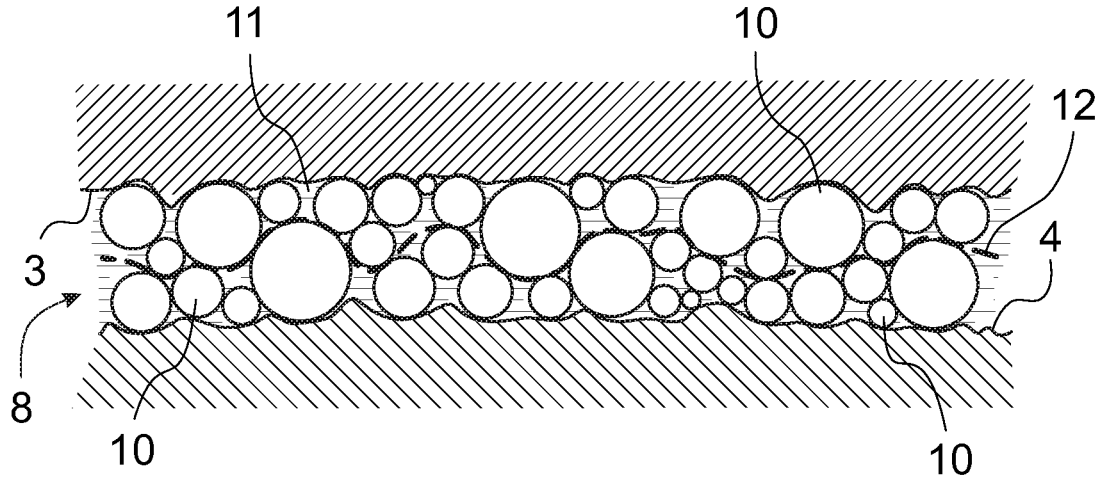

In the following, the invention will be described in detail by the aid of an example of its embodiment with reference to the attached drawing, wherein FIG. 1 presents a diagrammatic and simplified view of a traction sheave elevator with its rope tension chart as viewed from the side of the traction sheave, FIG. 2 presents a cross-section of one metal rope, such as a suspension rope of an elevator, lubricated with a lubricant, FIG. 3 presents a graph, compiled on the basis of measurement results, of the wearing of an elevator rope lubricated according to the invention, FIG. 4 presents a graph, compiled on the basis of measurement results, of the ratio of the slip percentage of two elevator ropes lubricated in different ways and also of the friction factor between the elevator rope and the rope groove, and FIG. 5 presents an enlarged cross-section of a metal rope, such as a suspension rope of an elevator, in a rope groove of a traction sheave, and lubricated with a lubricant according to the invention.

FIG. 1 presents a diagrammatic and simplified view of a typical traction sheave elevator, which comprises an elevator car 1, a counterweight 2 or balance weight and, fixed between these, elevator roping formed of elevator ropes 3 that are parallel to each other. The elevator ropes 3 are guided to pass over the traction sheave 4 rotated by the hoisting machine of the elevator in rope grooves dimensioned for the elevator ropes 3. As it rotates, the traction sheave 4 at the same time moves the elevator car 1 and the counterweight 2 in the up direction and down direction, due to friction.

Owing to the difference between the counterweight 2 and the elevator car 1 plus the load at any given time in the car, the rope forces $T_{CTW}$ and $T_{CAR}$ exerted on the elevator ropes 3 are of different magnitudes on different sides of the traction sheave 4. When the elevator car 1 contains less than one-half of the nominal load, the counterweight is generally heavier than the elevator car 1 with load. In this case the rope force $T_{CTW}$ between the counterweight 2 and the traction sheave 4 is greater than the rope force $T_{CAR}$ between the elevator car 1 and the traction sheave 4. Correspondingly, when the elevator car 1 contains over one-half of the nominal load, the counterweight 2 is generally lighter than the elevator car 1 with load. In this case the rope force $T_{CTW}$ between the counterweight 2 and the traction sheave 4 is smaller than the rope force $T_{CAR}$ between the elevator car 1 and the traction sheave 4. In the situation presented in FIG. 1, the rope force between the elevator car 1 and the traction sheave 4 is $T_{CAR}>T_{CTW}$. As a consequence, the rope tension acting on the elevator ropes 3 that is produced by the rope forces $T_{CTW}$ and $T_{CAR}$ in the rope grooves of the traction sheave 4 is not constant, but instead increases when going from the counterweight 2 side to the elevator car 1 side. This growing rope tension is diagrammatically presented in the tension chart 5 drawn in FIG. 1. As explained earlier, this tension difference tries to cause slipping of the elevator ropes 3 in the rope grooves. It is endeavored to compensate for the tension difference across the traction sheave 4 with a controlled slip, which can be implemented e.g. owing to the larger friction.

FIG. 2 presents a cross-section of a metal rope, such as a suspension rope 3 of an elevator for suspending and moving the elevator car. The suspension rope 3 of the elevator comprises strands 7 laid together around a core 6, which strands 7 for their part are laid e.g. from metal wires, such as from steel wires 9. The elevator rope 3 is lubricated with a lubricant 8 in connection with the manufacture of the rope. The lubricant 8 is between the strands 7 and also between the wires 9 of the strands, and the lubricant 8 is arranged to protect the strands 7 and the wires 9 from rubbing against each other. The lubricant 8 of the elevator rope 3 according to the invention also acts on the friction factor between the elevator rope 3 and the traction sheave 4 of the elevator, increasing the friction compared to elevator ropes lubricated with lubricating oil or lubricating grease according to prior art.

The lubricant 8 of a suspension rope 3 of an elevator according to the invention comprises at least some base oil suited to the purpose, some thickener, i.e. solid powder-like additive, that is preferably non-organic, and later referred as "powder substance", and also if necessary some binder agent, such as polyisobutene or some other suitable organic compound. The base oil, more briefly referred to as "oil", is e.g. some suitable synthetic oil that contains various additives, such as e.g. wear resistance agents and corrosion resistance agents. The task of the oil is, among other things, to prevent water from entering the rope 3 and to protect the rope from corrosion and wear. Anti-fretting and possibly also anti-seize types of lubricants are applicable to the purpose according to the invention as a lubricant of an elevator rope 3, even though there are restrictions caused by the application.

The powder substance of the lubricant 8 comprises one or more fine-grained solid substances comprising small particles of different sizes. At least a part of the particles, preferably a majority of the particles are suitably hard. The hardness of those particles on the Mohs scale is about equal to the hardness of the steel of the wires 9 of the rope, or greater than the hardness of the steel of the wires 9. Preferably the solid powder substances belong to the spinel group of minerals where common crystal forms are cubic or isometric, for instance octahedral.

Steel wires most usually used in elevators belong to strength classes 1370 $N/m^2$, 1570 $N/m^2$, 1770 $N/m^2$ and 1960 $N/m^2$, where the strength is calculated as nominal tensile strength. However, even stronger steel wires are used. Commercial elevators are provided even with steel wires whose nominal tensile strength is between 2000-3000 $N/m^2$. Usually stronger steel wires are also harder than steel wires with smaller strength.

The particles in the powder substance have a high specific weight. Thus the specific weight of the particles is many times greater than the specific weight of the used oil. For that reason the particles tend to descent onto the bottom of lubricant 8 at least in a long term storage. Preferably the lubricant 8 comprises additives that slow that kind of precipitation down or even prevent it.

The binder agent is arranged to keep the other materials of the lubricant 8, i.e. the oil, and the powder substance better together. The binder agent is e.g. an organically-based mass, such as a butene compound or some other substance suited to the purpose, e.g. a resin-based or wax-based substance.

The lubricant 8 is manufactured simply by mechanically mixing its different constituent parts with each other. The mixing ratios of the different constituents of the lubricant 8 are e.g. approx. 10-40%, preferably approx. 15-30%, suitably approx. 20%, oil; e.g. approx. 60-95%, preferably approx. 70-85%, powder substance; and e.g. approx. 0-5%, preferably approx. 0.2-3%, suitably approx. 0.3-0.6%, e.g. 0.4%, binder agent. The aforementioned percentage figures are percentages by weight. Owing to the large amount of powder substance, the structure of the lubricant 8 is a paste. With the help of the binder agent and powder substance, the lubricant 8 stays on the rope well and does not detach easily.

The lubricant 8 according to the invention differs from conventional lubricating grease in that, among other things, preferably the lubricant comprises a very high proportion of powder substance and less oil. The powder substance can account for e.g. at most 95%, in which case the proportion of base oil remains at 5% at the highest. Whereas with lubricating greases according to prior art the proportion of base oil in the grease is 80-90%, in which case the proportion of powder substance and other substances remains only at 10-20%.

FIG. 3 presents a graph compiled on the basis of the measurement results obtained in tests, of the wearing of elevator ropes lubricated in different ways. The curve p1 presents a rope lubricated with paraffin according to prior art, and the curve n1 presents a rope lubricated with the lubricant 8 according to the invention. The wearing of the ropes was tested with test equipment such that the rope was driven back and forth in a groove of a rope sheave and wearing of the rope was diagnosed from the reduction in diameter of the rope.

Both the ropes had the nominal diameter of 8 mm. The rejection limit in the tests was set to the value where the diameter of the ropes had become 6% thinner from the nominal diameter. In that case the rejection limit was 8*0.94=7.52 millimeters.

It can be seen from FIG. 3 that the rope p1 that were originally about 8.05 mm thick and lubricated with paraffin-based lubricant has thinned after approx. one million test cycles to become 7.54 millimeters thick in its diameter. The rejection limit 7.52 millimeters was reached before 1.2 million test cycles. Then the rope p1 seems to have essentially lost its fitness for purpose. On the other hand, the rope n1 that was lubricated with the lubricant 8 according to the invention has not really worn at all after the initial operational period even during the 10 million test cycles and is fit for use up till about 14 million test cycles. This is about 12 times more than with the rope p1.

FIG. 4 presents a graph, compiled on the basis of the results of measurements made in a laboratory, of the relationship between the friction factor of the rope groove of the traction sheave 4 and the slip percentage of a steel rope p1 lubricated with a paraffin-based lubricant according to prior-art and a steel rope n1 lubricated with the lubricant 8 according to the invention. The case shown here is thus the empirically obtained effective friction factor between two objects that slide against each other, and not the specific friction factor for an individual material.

It can be seen from the graph that in the case of a steel rope lubricated with a paraffin-based lubricant according to prior art, which is represented by the curve p1 in FIG. 4, the effective friction factor rises linearly and relatively fast in the initial phase of slip. When the slip is approx. 0.2%, the increase in the effective friction factor has slowed down, being in this phase now approx. 0.08. After this when the slip increases, the rise in the effective friction factor slows down even faster and does not increase over the approx. 0.09 limit here, even if the slip were to grow more. In this case, the situation is that the grip of the elevator rope in the groove of the traction sheave 4 has been lost.

Correspondingly, in the case of a steel rope lubricated with the lubricant 8 according to the invention, which is represented by the curve n1 in FIG. 4, the effective friction factor again rises linearly and relatively fast in the initial phase of slip. As the slip increases, the effective friction factor now also continues its increase, essentially linearly to a higher value of effective friction factor than with the rope represented by the curve p1. With the rope n1 lubricated with the lubricant 8 according to the invention, as the slip increases, the effective friction factor reaches a value of about 0.13. In this case considerably more grip reserve remains for the traction sheave 4 in case of unexpected situations, and larger values than 0.1, e.g. values about 0.13, can be used for the effective friction factor in the dimensioning. This enables a higher ratio $T_{CAR}/T_{CTW}$ of rope forces, in which case it is possible to achieve smaller moving masses, a further consequence of which is smaller acceleration forces, lower energy consumption and smaller losses. In addition, savings can be made in materials. Instead of making the elevator car lighter the better friction factor or friction grip can be utilized in several ways. For instance, it is not necessary to reduce acceleration because of slipping, and in addition it is possible to reduce under cutting in rope grooves and to increase rope force because surface pressure is now not a hindrance. That means in practice that the number of suspension ropes 3 can be reduced. And further, the better working lubrication makes it possible to use smaller rope pulleys.

FIG. 5 presents a greatly enlarged cross-section of a metal rope, such as a steel suspension rope 3 of an elevator, in a rope groove of a traction sheave 4, and lubricated with the lubricant 8 according to the invention. As mentioned earlier the lubricant 8 comprises a special powder substance that is powder like and comprises small solid particles 10 of different sizes. Preferably the particles 10 are rather round, advantageously in form of a sphere or chunk or an oval. Advantageously the ratio of the longest dimension to the shortest dimension of the particle 10 is close to one.

Besides the round or almost round shape, the hardness of at least a part of the particles 10, preferably a majority of the particles 10 on the Mohs scale is about equal to the hardness of the steel of the wires 9 of the rope, or greater than the hardness of the steel of the wires 9. One possible type of substances to be used are solid substances belonging to the spinel group of minerals which have crystal forms that are cubic or isometric, for instance octahedral, and therefore the particles of the these substances can approximately resemble spherical particles. For example, classified manganese (II, III) oxide, $Mn_3O_4$, is a substance that can be used as a powder substance in the lubricant 8 according to the invention. The hardness of $Mn_3O_4$ on the Mohs scale is about 5.5, which value corresponds to the hardness of the cutting edge of a good carbon steel blade of a knife.

It is also possible that manganese (IV) oxide or manganese dioxide, $MnO_2$ is used as a powder substance in the lubricant 8 according to the invention. The hardness of $MnO_2$ on the Mohs scale is about 5. In that case the hardness of $MnO_2$ is also greater than the hardness of the steel of the most commonly used wires 9.

Preferably the hardness of the particles 10 of the main substance of the powder substance is greater than 4, for instance between 4 and 6, and suitably between 5 and 5.5 on the Mohs scale.

FIG. 5 shows in a greatly enlarged view how the mainly round or almost round solid particles 10 of the powder substance in the lubricant 8 are located between the surfaces of the suspension rope 3 and the rope groove of the traction sheave 4. Between the solid particles 10 the lubricant 8 has synthetic oil 11 and binder agents, the amounts of them has been mentioned earlier. The thickness of the layer of the particles 10 between the two adjacent steel surfaces is greater than the surface roughness of each of the steel surfaces. In that case the particles 10, being harder or at least as hard as the steel surfaces, prevent the two steel surfaces from touching each other. That reduces the wear of the suspension rope 3 and also the rope grooves of the traction sheave 4. The slip plane 12 between the two surfaces is more or less curvilinear somewhere between the particles 10, and can change all the time.

The inventor believes that the lubrication performance of the lubricant 8 according to the invention is that the more or less spherically shaped hard particles 10 of the powder substance form a layer between the sliding and/or rolling surfaces of the suspension rope 3 and traction sheave 4, which layer prevents the contact between surface asperities. At the same time the particles 10 form a complex slip plane 12, which is not easily sheared and thus increases the friction but at the same time reduces wear of the surfaces. Due to their more or less spherical shape the hard particles 10 do not cause abrasive wear. Because of the different sizes of the particles 10 they can lock each other effectively in a dynamic contact situation between the contact surfaces.

The size distribution of the particles 10 is preferably such that a part of the particles 10 are greater than the asperity of the surfaces of the suspension rope 3 and the groove of the traction sheave 4. For example, one possible size distribution of the particles 10 is as follows: the powder substance contains 0% particles greater than 63 μm, 1% particles between 20 and 63 μm, 16% particles between 6.3 and 20 μm, 63% particles between 2 and 6.3 μm, and 20% particles smaller than 2 μm. Other size distributions with other particle sizes and percent distributions are also possible. A part of the particles 10 are smaller than the asperity of the surfaces of the suspension rope 3 and the groove of the traction sheave 4. In case of greater proportion of small particles, the total surface area of the particles being in contact with oil is larger.

It is clearly verified by the tests described above that, owing to the high proportion of powder-like powder substance with hard and more or less spherical particles 10 contained in the lubricant 8, the lifetime of an elevator suspension rope 3 lubricated with the lubricant 8 is considerably longer than the lifetime of elevator ropes lubricated with prior-art lubricants, and in addition the friction factor between the rope 3 and the traction sheave 4 is greater than when using conventional lubricants, which enables more advantageous dimensioning.

One characteristic aspect, among others, of the elevator according to the invention is that the elevator is provided with suspension ropes 3 that are lubricated with the lubricant 8 that contains the powder substance with hard solid particles 10 mentioned above, and the load-bearing material of the suspension ropes 3 is metal, e.g. steel. The whole mass of the lubricant 8 comprises a suitable aforesaid percentage of the powder substance with the substantially hard and substantially spherical particles 10. In addition, the lubricant 8 can contain the aforementioned binder agents and other additives.

The use of the aforementioned lubricant 8 that contains powder substance for lubricating a rope laid from metal wires 9 is further characteristic for the solution according to the invention.

It is obvious to the person skilled in the art that different embodiments of the invention are not only limited to the examples described above, but that they may be varied within the scope of the claims presented below. Thus, for example, the composition of the lubricant and the mixture ratio of the different constituents can also be different to what is described above.

Likewise it is obvious to the person skilled in the art that instead of synthetic oil, mineral oils or vegetable oils suited to the purpose can also be used as an oil in the lubricant.

The invention claimed is:

1. A steel wire rope, comprising:

one or more strands including steel wires; and a lubricant, the lubricant including an oil and an amount of a powder substance, wherein the lubricant is in a form of paste and the powder substance includes particles having a hardness that is greater than a Mohs Scale hardness of 4.

2. The steel wire rope according to claim 1, wherein the hardness of the particles is equal to or greater than a hardness of a steel of the steel wires of the one or more strands.

3. The steel wire rope according to claim 1, wherein each particle of the particles has an internal aspect ratio that is a ratio of a longest dimension of the particle to a shortest dimension of the particle, and the internal aspect ratio is between 1 and 5.

4. The steel wire rope according to claim 1, wherein a shape of each of the particles is spherical.

5. The steel wire rope according to claim 1, wherein the particles belong to a spinel group of minerals, the spinel group of minerals having crystal forms that are cubic or isometric.

6. The steel wire rope according to claim 1, wherein the powder substance includes manganese (II, III) oxide, $Mn_3O_4$, and/or manganese (IV) oxide, $MnO_2$.

7. The steel wire rope according to claim 6, wherein the powder substance is manganese (II, III) oxide, $Mn_3O_4$, and/or manganese (IV) oxide, $MnO_2$.

8. The steel wire rope according to claim 1, wherein a particle size of at least some of the particles is greater than an asperity of a contact surface of the steel wire rope and a counter contact surface of the steel wire rope.

9. The steel wire rope according to claim 1, wherein the lubricant includes a binder agent, a proportion of the binder agent in the lubricant being in a range of 0-5 weight-% of an amount of the lubricant.

10. A traction sheave elevator, comprising:

an elevator car; and a plurality of suspension ropes, each suspension rope including one or more strands composed of steel wires, wherein the plurality of suspension ropes are led to pass over a traction sheave, the traction sheave provided with a hoisting machine, wherein each suspension rope of the plurality of suspension ropes is lubricated with a lubricant, the lubricant including an oil, and a powder substance, the powder substance including particles, the particles having a hardness that is greater than a Mohs Scale hardness of 4.

11. The traction sheave elevator according to claim 10, wherein each suspension rope includes strands, the strands include wires, and the wires include steel, and the hardness of the particles is equal to or greater than a hardness of the steel of the wires.

12. The traction sheave elevator according to claim 10, wherein each particle of the particles has an internal aspect ratio that is a ratio of a longest dimension of the particle to a shortest dimension of the particle, and the internal aspect ratio is between 1 and 5.

13. The traction sheave elevator according to claim 10, wherein the particles belong to a spinel group of minerals, the spinel group of minerals having crystal forms that are cubic or isometric, for instance octahedral.

14. The traction sheave elevator according to claim 10, wherein the powder substance in the lubricant of the suspension ropes of the traction sheave elevator comprises classified manganese (II, III) oxide, $Mn_3O_4$ and/or manganese (IV) oxide, $MnO_2$.

15. A rope lubricant for a steel wire rope, the steel wire rope including one or more strands composed of steel wires, the rope lubricant comprising:

an oil; and a powder substance, wherein the rope lubricant is in a form of paste and the powder substance includes particles having a hardness that is greater than a Mohs Scale hardness of 4.

16. The Rope lubricant according to claim 15, wherein the hardness of the particles is about equal to the hardness of a steel of the steel wires of the one or more strands of the steel wire rope, or greater than the hardness of the steel of the steel wires of the one or more strands of the steel wire rope.

17. The Rope lubricant according to claim 15, wherein each particle of the particles has an internal aspect ratio that is a ratio of a longest dimension of the particle to a shortest dimension of the particle, and the internal aspect ratio is between 1 and 5.

18. The Rope lubricant according to claim 15, wherein the particles belong to a spinel group of minerals, the spinel group of minerals having crystal forms that are cubic or isometric.

19. The Rope lubricant according to claim 15, wherein the powder substance includes manganese (II, III) oxide, $Mn_3O_4$, and/or manganese (IV) oxide, $MnO_2$.

20. A method, comprising:

applying a lubricant to a rope to lubricate the rope, wherein the rope includes metal as a load-bearing material, wherein the lubricant includes at least an oil and a powder substance, wherein the powder substance includes particles having a hardness that is greater than a Mohs Scale hardness of 4.

21. The method according to claim 20, wherein the rope includes strands, the strands includes wires, and the wires include steel, and the hardness of the particles is equal to or greater than a hardness of the steel of the wires of the strands of the rope.

22. The method according to claim 20, wherein each particle of the particles has an internal aspect ratio that is a ratio of a longest dimension of the particle to a shortest dimension of the particle, and the internal aspect ratio is between 1 and 5.

23. The method according to claim 22, wherein the internal aspect ratio is between 1 and 2.

24. The method according to claim 20, wherein the powder substance includes manganese (II, III) oxide, $Mn_3O_4$, and/or manganese (IV) oxide, $MnO_2$.

* * * * *